US006518886B1

(12) United States Patent
Elston

(10) Patent No.: US 6,518,886 B1
(45) Date of Patent: Feb. 11, 2003

(54) PROTECTIVE PERMANENT HOUSING FOR ANTI-THEFT TAG

(75) Inventor: Stephen Elston, Ormond Beach, FL (US)

(73) Assignee: World Color, Inc., Ormond Beach, FL (US)

( * ) Notice: Subject to any disclaimer, the term of this patent is extended or adjusted under 35 U.S.C. 154(b) by 0 days.

(21) Appl. No.: 09/660,306

(22) Filed: Sep. 12, 2000

(51) Int. Cl.[7] ..... G08B 13/14

(52) U.S. Cl. ..... 340/572.8; 340/693.12; 340/693.9; 340/572.1; 340/571

(58) Field of Search ..... 340/572.8, 572.1, 340/572.9, 571, 693.5, 693.12, 693.9

(56) References Cited

U.S. PATENT DOCUMENTS 5,859,587 A * 1/1999 Alicot et al. ..... 340/572.8
5,949,336 A 9/1999 Deschenes et al. ..... 340/572.8
5,955,951 A 9/1999 Wischerop et al. ..... 340/572.8
5,982,282 A 11/1999 Ryan, Jr. ..... 340/572.1
6,121,880 A * 9/2000 Scott et al. ..... 340/572.5

* cited by examiner

*Primary Examiner*—Daryl Pope
(74) *Attorney, Agent, or Firm*—Allen, Dyer, Doppelt, Milbrath & Gilchrist, P.A.

(57) ABSTRACT

A protective housing for an electronic article surveillance (EAS) tag is adhered directly to an article with an adhesive layer that is difficult to remove. The housing comprises a cavity defined by a base and rectilinear side walls, with the EAS tag secured against the base. The dimension of the side walls together with the adhesive layer is significantly greater than the thickness of the EAS tag, so that there is a substantial portion of the cavity between the EAS tag and the article to which the housing is attached.

9 Claims, 1 Drawing Sheet

PROTECTIVE PERMANENT HOUSING FOR ANTI-THEFT TAG

BACKGROUND OF THE INVENTION

1. Field of the Invention

This invention relates to a protective housing permanently adhered to an article of commerce for securing an electronic article surveillance (EAS) tag to deter theft of the article, to combinations of the article with the EAS tag and the housing, and to methods making the same.

2. The State of the Art

Antitheft tags for consumer articles are well-known, and systems using such devices are referred to as electronic article surveillance (EAS) systems. Exemplary of housings for EAS devices and systems using the same are U.S. Pat. Nos. 5,949,336 and 5,955,951, and the reference cited there. In one embodiment, EAS tags have a circuit having a known resonant frequency and inducible to resonate by an externally applied magnetic or RF field, the existence of the expected resonance being evidence of the article; hence, placing a sensor for such a device at the exit of an establishment indicates that an article of merchandise with such a device is being taken from the store.

EAS devices and systems are well-known and do not form part of this invention. Rather, one aspect that retailers and manufacturers find is important is to keep the EAS tag as small and unobtrusive as possible. For example, the above-noted U.S. Pat. No. 5,955,951 describes a relatively large EAS tag that is secured with a tack through clothing, and the U.S. Pat. No. 5,949,336 patent describes a less obtrusive device but one which looks like a plastic tag of some sort.

Yet another problem is that potential shoplifters may attempt to remove from the merchandise an EAS tag, or any tag (including, for example, a price tag) that is easily identifiable as such. An EAS housing sold by B&G Plastics, Inc. (Newark, N.J. and Kowloon, Hong Kong) has a clamshell casing in which an EAS tag is housed, and the whole device is attached to merchandise. Thus, while the EAS tag is secured, the housing may be removed from the article. While some merchants and manufacturers have placed EAS tags on the cartons or boxes in which merchandise is packaged, shoplifters have avoided such anti-theft devices by merely removing the merchandise from the packaging.

SUMMARY AND OBJECTS OF THE INVENTION

Embodiments of this invention include one or more of the following features. The provision of a secured housing in which an EAS device is located that is attached to an article of commerce in an unobtrusive manner.

To provide an EAS device in a recess formed directly in the article of commerce.

The provision of an EAS tag in a housing, the housing having the general geometry of a rectilinear solid with one long face open, and a permanent adhesive on the edges of the open face, and with the adhesive attached to a release layer for later attachment to the article commerce.

The housing has a height dimension substantially greater than that of the EAS tag so as to define a cavity between the EAS tag and the open face. This height dimension is increased by the adhesive on the edges of the open face of the housing.

DETAILED DESCRIPTION OF SPECIFIC EMBODIMENTS

As noted in the Background section, EAS devices are well-known and can be found described in such patents as U.S. Pat. No. 5,949,336 and U.S. Pat. No. 5,955,951, the disclosures of which are incorporated herein by reference in their entirety.

Figure 1:
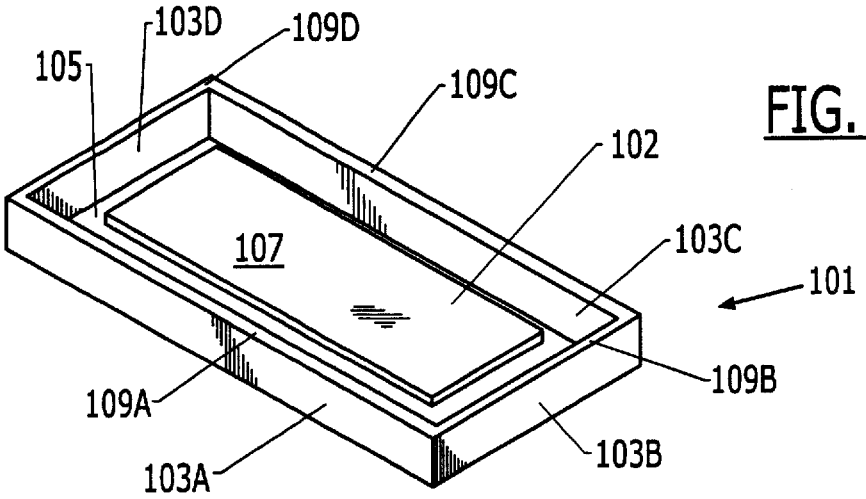
FIG. 1 depicts an idealized bottom perspective view of a housing having an EAS tag therein and edges for the application of a permanent adhesive.

FIG. 1 depicts a bottom perspective view of one embodiment of the invention. The casing 101 is made of a tough and durable plastic, preferably molded into a right rectilinear shape; as shown in the figure, the device has four upstanding walls 103A, 103B, 103C and 103D attached to a base 105 to form a cavity 102 in which an EAS device 107 is secured, preferably by gluing. In essence, the housing 101 is in a right rectilinear geometry with an opening to the cavity 102 opposite the base 105. Each of the walls 103A–D has a thickness sufficient to provide respective edges 109A, 109B, 109C and 109D so that the housing 101, with the EAS device 107 therein, can be adhered to an article of commerce (not shown) with an adhesive layer along the edges 109A–D. The EAS device is glued to the base of the housing using a conventional adhesive. Although not preferred, the EAS tag 107 can be merely housed therein, and thus is likely to rattle around inside unless the tolerances of the housing 101 are such as to assure a tight fit; however, the cost to provide such a high tolerance housing are outweighed by using a conventional adhesive to secure the EAS tag 107 to the housing. One typical EAS tag 107 is about 1¾ inches by 7/16-ths inch; the housing 107 is typically about 2 inches long by about ¾ inch wide and with the walls 103A–D having a height on the order of ⅛ inch or greater so that the walls together with a thickness of adhesive along edges 109A–D provide as shown in FIG. 1, a significant portion of the cavity 102 between the EAS tag 107 and the article to which the housing 101 is attached. the plastic is preferably a thermoplastic, such as styrene polymers and copolymers (such as ABS), polyalkylene, polycarbonate, polyamides and polyimides, and epoxies, and may be filled with organic or inorganic materials, including fibers (polyalkylene staple fibers) and particles (alumina powder, mica flake).

Figure 2:
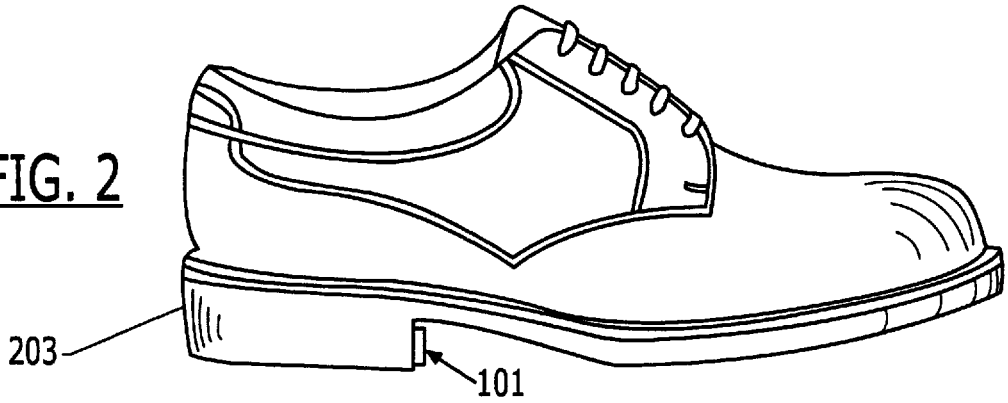
FIG. 2 depicts an idealized side view of a show having the novel housing and EAS tag adhered thereto in an unobtrusive manner.

FIG. 2 depicts an idealized side view of a shoe 201 having a conventional heel 203. The housing 101 with the EAS tag can be permanently glued to any non-porous surface, including plastics, rubbers, metals, ceramics, glass, and the like; of course a plastic with holes would be porous, and so the term non-porous is intended to indicate a non-absorbent surface with little elongation that cannot readily be deformed and that would be recognized as suitable for adhering the instant housing. For example, the housing can be glued with a permanent adhesive such as 3M brand SCOTCH 4932 foam tape. For a shoe, the housing can be placed on the inner face as shown in FIG. 2. For other devices, the housing with the EAS tag can be secured where desired.

Any suitable permanent adhesive will suffice and it need not be tape or foam tape based. For example, it is preferred to coat each of the housings with a permanent adhesive and then apply a release layer so that they can be shipped in bulk; it is even more preferred that the release layer be in the form of a continuous roll. The housings (with the EAS tag) can then be applied to individual articles of commerce using conventional apparatus. By "permanent" adhesive is meant an adhesive that is very difficult to remove, would likely be impossible to remove with one's bare hands, and is even difficult to remove with tools. As such, the present device can be used with articles of commerce ranging in size from televisions and other consumer electronic goods, where it could be placed on the bottom of the merchandise and should have a profile less than the legs of the device, to circuit breakers and saw blades sold in home improvement stores, where the device could be removed (with difficulty) with a chisel or the like.

Figure 3:
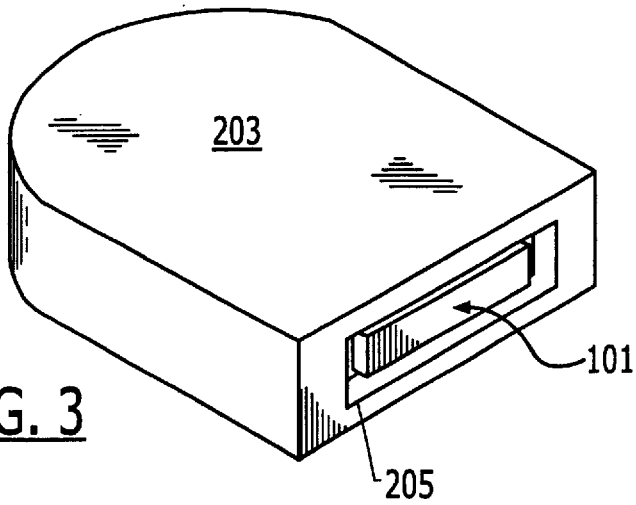
FIG. 3 depicts an idealized perspective view of a heel having a cavity in which the novel housing and EAS tag is secured.

Merchandise may be made with a recess into which the housing 101 with the EAS device can be permanently adhered. For example, as shown in FIG. 3, a conventional heel 202 can be molded with a recess 205 adapted to accommodate the EAS device and the surrounding housing 101. Preferably, such a recess has a depth greater than the height profile of the housing. Thus, for any device made of plastic, such as the housing of an iron, a circuit breaker, the housing of a consumer electronic device, the sole of a sneaker or boot, can be molded with a recess in which the present device can be secured. Likewise, any ceramic or metal merchandise which can be molded or stamped with a recess is suitable for use with the present invention.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A combination of an electronic surveillance device and an outer housing comprising:

a. an electronic surveillance article device including,
  i. a housing,
  ii. an active element placed in said housing; and b. an outer housing including,
  i. a base having the device housing fixed thereto;
  ii. at least one upstanding wall attached to said base so as to provide an edge, and
  iii. a permanent adhesive on said edge so as to permanently affix the outer housing to an article of commerce.

2. The combination of claim 1, further comprising a release layer covering the edge and permanent adhesive.

3. The combination of claim 2, wherein the release layer is provided in a continuous roll.

4. The combination of claim 1, further comprising an article of commerce having a non-porous surface to which said outer housing is adhered.

5. The combination of claim 4, wherein the article of commerce has a recess in a surface thereof, said recess adapted to receive the outer housing with the electronic article surveillance device therein, and said outer housing with the electronic article surveillance device is adhered in the recess.

6. The combination recited in claim 1, wherein the upstanding wall comprises enclosing walls defining a cavity and an open face of the housing opposite the base.

7. The combination recited in claim 6 wherein the enclosing walls have a dimension between the base and the open face that, together with the adhesive on the edge, provides a substantial distance in the cavity between the EAS device and an article to which the housing is attached.

8. The combination recited in claim 7, further comprising a release layer over the cavity and the adhesive.

9. The combination recited in claim 7, wherein the dimension of the walls is on the order of ⅛ inch or greater.

* * * * *

UNITED STATES PATENT AND TRADEMARK OFFICE

CERTIFICATE OF CORRECTION

PATENT NO. : 6,518,886 B1 
DATED : February 11, 2003
INVENTOR(S) : Stephen Elston It is certified that error appears in the above-identified patent and that said Letters Patent is hereby corrected as shown below:

Title page,
Item [*] Notice, please strike "0 days" and insert -- 82 days -- thereof.

Signed and Sealed this

Ninth Day of September, 2003

JAMES E. ROGAN
*Director of the United States Patent and Trademark Office*